US007549903B2

(12) United States Patent
Andersson

(10) Patent No.: US 7,549,903 B2
(45) Date of Patent: Jun. 23, 2009

(54) METHOD AND AUXILIARY DEVICE FOR DISASSEMBLY/ASSEMBLY OF A TUNNEL THRUSTER

(75) Inventor: Lars-Göran Andersson, Kristinehamm (SE)

(73) Assignee: Rolls-Royce Aktiebolag, Kristinehamn (SE)

( * ) Notice: Subject to any disclaimer, the term of this patent is extended or adjusted under 35 U.S.C. 154(b) by 0 days.

(21) Appl. No.: 11/578,950

(22) PCT Filed: Apr. 12, 2005

(86) PCT No.: PCT/SE2005/000520

§ 371 (c)(1),
(2), (4) Date: Jul. 13, 2007

(87) PCT Pub. No.: WO2005/100151

PCT Pub. Date: Oct. 27, 2005

(65) Prior Publication Data

US 2007/0289516 A1 Dec. 20, 2007

(30) Foreign Application Priority Data

Apr. 19, 2004 (SE) ..... 0401006

(51) Int. Cl.
*B63H 5/16* (2006.01)
*B63H 25/46* (2006.01)

(52) U.S. Cl. ..... 440/68; 114/151

(58) Field of Classification Search ..... 440/49
See application file for complete search history.

(56) References Cited

U.S. PATENT DOCUMENTS 3,550,547 A * 12/1970 Pleuger et al. ..... 114/151
4,066,035 A 1/1978 Haglund et al.
4,634,389 A 1/1987 Eptaminitakis
4,696,650 A 9/1987 Haglund

OTHER PUBLICATIONS

International Search Report Dated Jun. 27, 2005.

* cited by examiner

*Primary Examiner*—Jesus D Sotelo
(74) *Attorney, Agent, or Firm*—Michael Bednarek; Paul, Hastings, Janofsky & Walker LLP

(57) ABSTRACT

The present invention relates to a method and an auxiliary device in connection with disassembly and/or assembly of a tunnel thruster unit by use of the auxiliary device (1) to guide the thruster unit (2) and its movement during disassembly/assembly inside the tunnel (4), the thruster unit (2) thereafter being led away through the tunnel (4), said auxiliary device (1) being removably fixed at the thruster unit (2) before final disassembly, such that the auxiliary device (1) controls the movement during disassembly/assembly, mainly by compressive forces.

12 Claims, 3 Drawing Sheets

Fig. 6
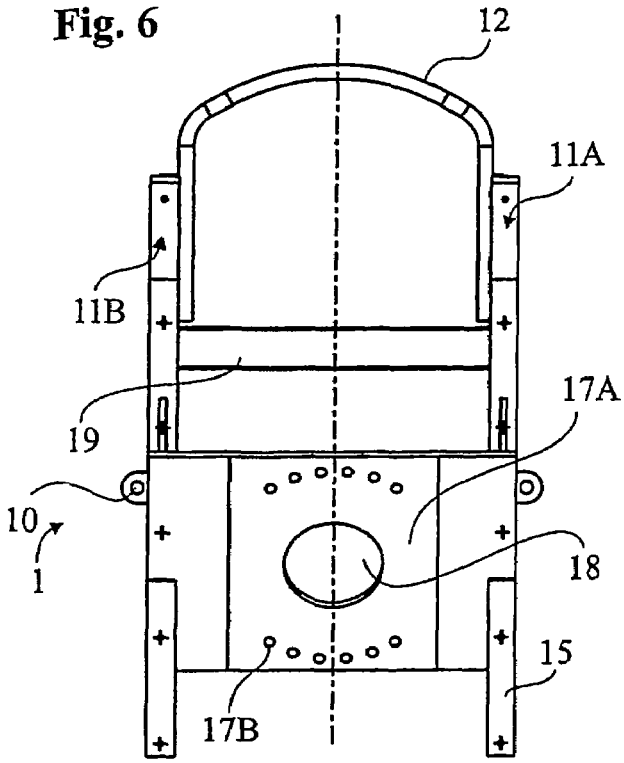
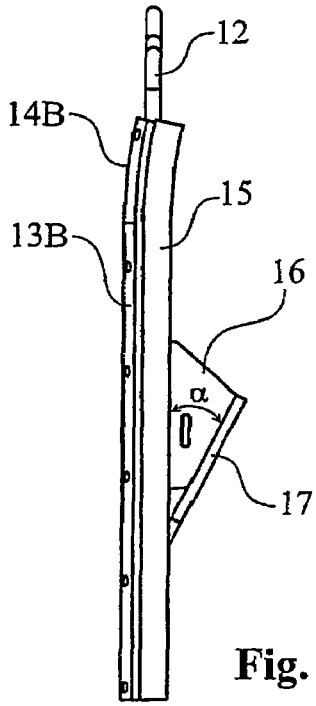
Fig. 7
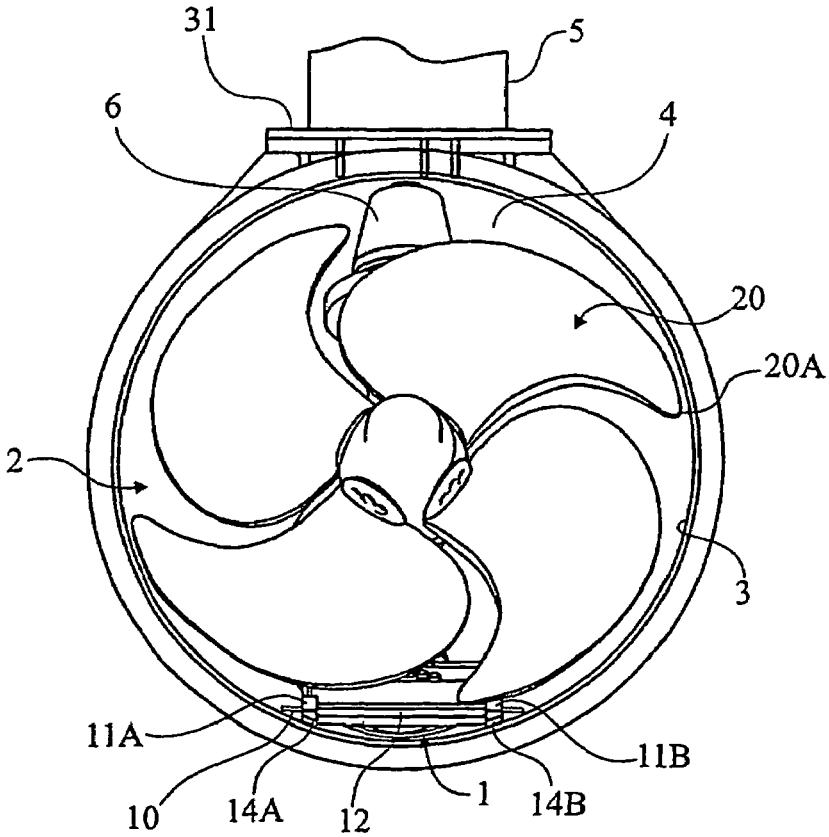
Fig. 5

METHOD AND AUXILIARY DEVICE FOR DISASSEMBLY/ASSEMBLY OF A TUNNEL THRUSTER

TECHNICAL FIELD

The present invention relates to an auxiliary device and a method in connection with the disassembly and/or assembly of a tunnel thruster unit by use of an auxiliary device to guide the thruster unit and its movement during disassembly/assembly inside the tunnel, where after the thruster unit is led away through the tunnel.

PRIOR ART

A tunnel thruster is a propeller unit mounted in a tunnel to achieve a lateral thrust in order to steer a ship or a platform. In order to facilitate, the term "thruster unit" will in the following be used to denote the actual propeller unit for such a tunnel thruster. Some complications exist when disassembling or assembling such a tunnel thruster. One complication is the limited space defined by the tunnel, leading to difficulties in the disassembly/assembly. One such difficulty is that the propeller at the thruster unit is easily damaged during disassembly/assembly due to narrow margins between the propeller ends and the tunnel wall.

Prior art of today, essentially according to the principles of U.S. Pat. Nos. 4,036,163 and 4,696,650, makes use of wires/cables in order to lower the thruster unit before it is transported out through the tunnel. It is realised that in the limited space offered by the tunnel for the mechanician to work in, it may be difficult by such a method to achieve appropriately controlled guiding. Yet another difficulty is caused by the drive shaft of the thruster unit having to project beyond its point of attachment in the tunnel, whereby the height of the thruster unit will be considerably much larger than the diameters of the propeller and tunnel. This is because it is desired, in order to achieve a good thruster capacity, to have a tunnel diameter that is as close as possible to the propeller diameter, which means that the thruster unit must be tilted for transport into and out of the tunnel. Accordingly, the thruster unit must be both lowered and tilted in connection with disassembly, and the opposite in connection with assembly, which of course increases the risk that the unit at some point of time can not be guided at adequate precision in order to avoid contact between the propeller tip and the tunnel surface during disassembly/assembly. Moreover, there is a difficulty in that the thruster unit must be precisely guided during transport out of the tunnel, in order also in this phase to be able to avoid contact between the propeller tip and the tunnel surface. It is realised that the complications mentioned above mean that today it is avoided to perform such operations below the water surface, since underwater assembly constitutes an additional complication to the method in terms of guiding and control. Today, such operations are accordingly made in a dry dock, which is very costly, quite often meaning a cost of at least 200,000 Euro per day, excluding downtime costs for the ship.

BRIEF ACCOUNT OF THE INVENTION

It is an object of the present invention to eliminate or at least minimize at least one of the above mentioned problems, which is achieved by aid of a method in connection with the disassembly and/or assembly of a tunnel thruster unit by use of an auxiliary device to guide the thruster unit and its movement during disassembly/assembly inside the tunnel, where after the thruster unit is led away through the tunnel, by said auxiliary device being removably fixed at the thruster unit before final disassembly, whereby the auxiliary device controls the movement during disassembly/assembly, mainly by compressive forces.

The invention also relates to an auxiliary device for conducting the method.

Thanks to the new method and the auxiliary device, the assembly/disassembly can be facilitated, and the thruster unit can be guided with complete control during disassembly/assembly, so that damages on the propeller ends can be completely avoided. Thanks to the new approach of utilising a rigid construction to guide the movement of the thruster unit, many advantages are achieved, which among other things means that in a preferred embodiment disassembly/assembly can be made underwater, so that considerable cost/time savings can be achieved.

According to further aspects of the invention:

- Said auxiliary device is designed to be able to carry the full weight of the thruster unit and also to be used for transport inside the tunnel, away from the site of disassembly and/or to the site of assembly. Thanks to this aspect, the advantage is achieved that one and the same auxiliary device is used both to guide the thruster unit downwards during disassembly (the reverse during assembly) and for transport, to achieve a safe transport through the tunnel.
- Said thruster unit is provided with a first interface and the auxiliary device is provided with a second interface for said fixing. Thanks to the utilisation of such an interface, a fast and accurate fixing can be achieved of the auxiliary device to the thruster unit.
- The said first interface is directed downwards, such that the thruster unit is carried on top of said auxiliary device during transport. Thanks to this design, a possibility is achieved to form a compact auxiliary device.
- The said compressive force arises in connection with the contact between the auxiliary device and an adjacent surface, giving rise to a counter force being created in at least one wall section of said tunnel, said adjacent surface preferably being formed by said wall section. Thanks to this aspect, no additional facilities need to be constructed in connection with disassembly/assembly and/or transport, but instead the tunnel wall or optionally some additional sliding surface can be used to conduct the method.
- The said auxiliary device is provided with at least one guiding member, and said guiding takes place by a sliding and/or turning movement between said guiding members and said adjacent surface. This aspect means yet another simplification, mainly of the work load in connection with disassembly.

The disassembly and/or the assembly takes place underwater. Thanks to the invention, disassembly/assembly is facilitated such that underwater operation can be performed, whereby considerable time and cost savings can be achieved.

The invention also relates to an auxiliary device for disassembly of a tunnel thruster unit, which auxiliary device is intended to contribute to a controlled disassembly/assembly of a thruster unit inside the tunnel, said auxiliary device comprising a rigid construction with at least one guiding member comprising a sliding member, preferably in the form of a curved portion. As has already been stated, the use of such an auxiliary device results in considerable advantages.

According to further aspects of the auxiliary device:

- The said construction also comprises a transport member. It is realised that considerable advantages can be achieved as one and the same auxiliary device can be used both for the guiding and for the transport.

Said guiding members are arranged at said transport member. Thanks to this aspect, the advantage is obtained that the auxiliary device can be formed to be compact, and to be rationally manufactured.

Said transport member is composed of at least one elongated member, preferably at least two elongated members. Thanks to this aspect, a beneficial stability and strength of the auxiliary device is easily achieved.

The auxiliary device comprises in interface that extends in a plane that forms an acute angle with the main extension of said elongated member, said angle preferably being less than 45° but greater than 5°. Thanks to the angle between the interface and the transport members, the positioning of the thruster unit inside the tunnel can be defined relative the auxiliary device such that a desired positioning is achieved inside the tunnel, including a clearance.

The said guiding member is composed of at least one curved surface. Thanks to the use of a curved surface for the guiding, a simple and relatively cheap and reliable guiding mechanism is achieved.

The said guiding surfaces are arranged at a front end of said elongated members. Thanks to this arrangement, rational manufacturing is enabled.

The said transport member is provided with at least one wear member comprising a sliding surface. According to this aspect of the invention, maintenance work for the auxiliary device can be facilitated/simplified at the same time as it enables utilisation of sliding members on the auxiliary device that are especially gentle to the base material inside the tunnel and/or any other location on which the auxiliary device is moved.

BRIEF DESCRIPTION OF THE DRAWINGS

In the following, the invention will be described in greater detail with reference to the attached drawing figures, of which:

FIG. 5 shows a cross-section through a tunnel with a disassembled thruster unit according to FIG. 4, FIG. 6 shows a preferred auxiliary device as seen from above, FIG. 7 shows the auxiliary device as seen from the side.

DETAILED DESCRIPTION

Figure 1:
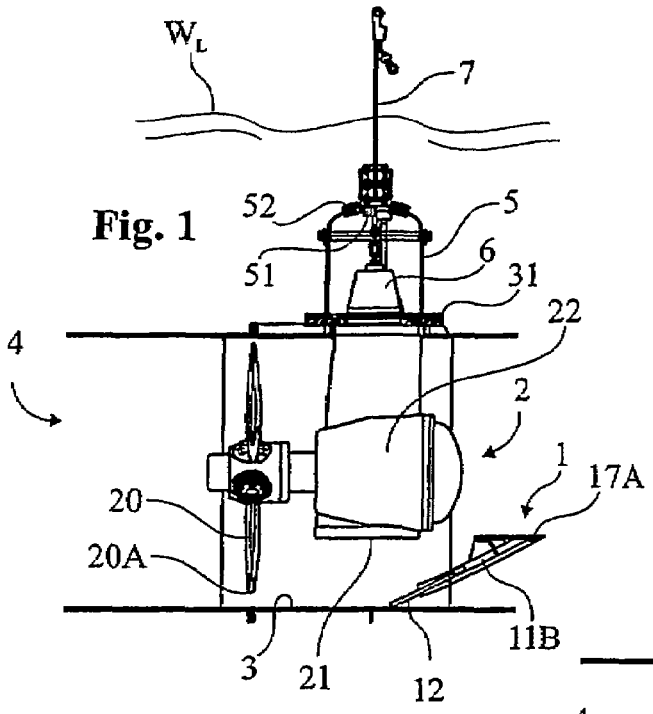
FIG. 1 shows a side view of a tunnel thruster according to the invention, at a phase before final disassembly according to a preferred method has been conducted.

FIG. 1 shows, in a side view, a cross-section of a tunnel 4 inside which a propeller unit is mounted, a so called tunnel thruster 2. The thruster unit 2 comprises a propeller 20 journalled in a gear mounting/housing 22, which in turn is fixed via a flange 31 inside the tunnel 4, as is known per se. The tunnel 4 is delimited by a cylindrical wall 3 in the middle of which said flange 31 is arranged at the top.

FIG. 1 shows an initial phase of a disassembly of such a tunnel thruster 2. The motor shaft (that drives the propeller 20 via the gear housing) has been disconnected, and instead a watertight mounting hood 5 is (as is known per se) fitted on the axle journal of the thruster unit 2. A new improvement in connection with this hood 5 is that at least one light bulb 51 is arranged inside the hood 5, in an area between the transparent caps 52 at the upper end wall of the hood, such that it is easy for a mechanician to work in good illumination, without the need of supplementary illumination that otherwise has to be provided by an electric torch. At the end of this axle journal a wire 7 is arranged, which is intended to be used in a later phase when the tunnel thruster unit 2 is to be lowered. It is further shown in FIG. 1 that the thruster unit 2 at its bottom end is provided with a planar surface 21, that constitutes a first interface. The said interface is intended to be connected with a corresponding second interface 17A of an auxiliary device 1 that is shown in a preferred embodiment separate from the tunnel thruster 2, in FIG. 1. This auxiliary device 1 comprises elongated runners 11A, 11B, whereof one is shown in FIG. 1. A pulling means 12 is arranged in the front section of said runners. The design of the preferred embodiment of the auxiliary device 1 is described in greater detail with reference to FIGS. 5-7 below.

Figure 2:
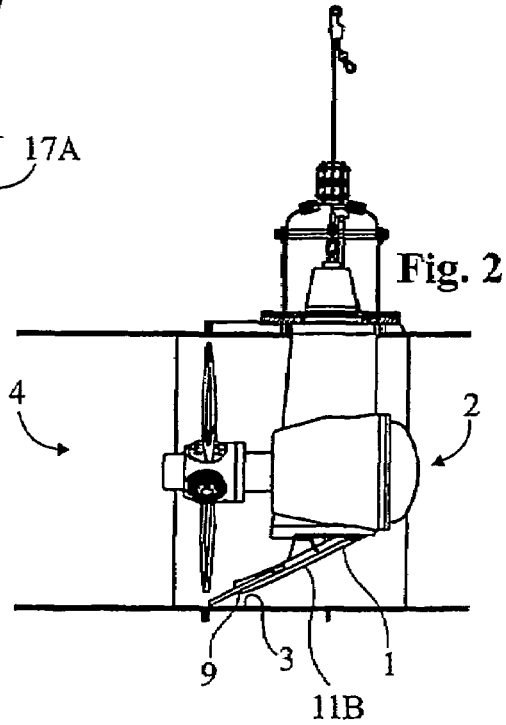
FIG. 2 shows the same tunnel thruster in an early phase of the disassembly, in which a preferred auxiliary device has been fixed to the thruster unit.

FIG. 2 shown the next phase of the disassembly of the tunnel thruster 2. In this phase, the auxiliary unit 1 has been fixed to the thruster unit 2. The fixing takes place by bringing both interface surfaces 21, 17A together, where after the auxiliary unit 1 is fixed by aid of screws in threaded holes (not shown) prepared in the tunnel thruster 2. When the auxiliary device 1 has been fixedly attached, all attaching bolts that connect the tunnel thruster 2 with the flange 31 can be released (as is known per se), such that the entire weight of the tunnel thruster thereafter hangs in the wire 7.

Figure 3:
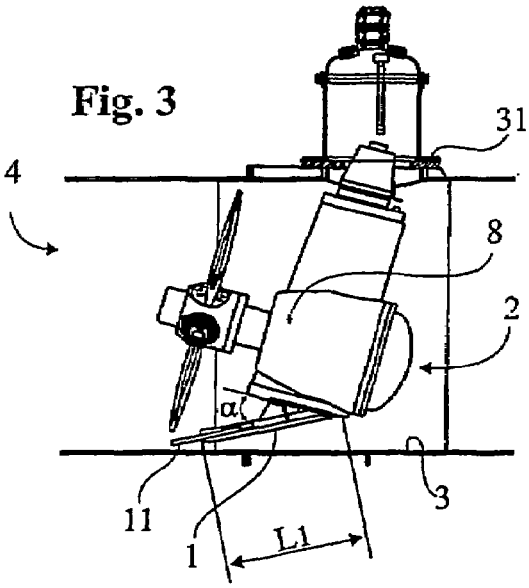
FIG. 3 shows the disassembly in a phase in which the thruster unit is disassembled half-way down from the position of attachment.

FIG. 3 shows the next phase of the disassembly, in which the wire 7 (not shown) has been lowered a certain distance. The tunnel thruster 2, that is now fixedly attached to the auxiliary device 1, will then be moved downwards, but also diagonally forwards. The movement diagonally forwards results from the centre of gravity 8 of the tunnel thruster 2 being positioned behind the point 9 of contact between the end sections 14A, 14B of the runners (see FIG. 5) and the tunnel wall 3. Accordingly, the auxiliary device 1 is influenced by a torque that turns clockwise about the contact point 9. The horizontal component following from this torque is considerably larger than the frictional force between the tunnel wall 3 and the contact surfaces 14A, 14B of the runners 11A, 11B, which means that a sliding movement arises. This means that the auxiliary device 1 with the tunnel thruster 2 will slide out from the tunnel (to the left in the drawing), whereby a is turning movement of the tunnel thruster 2 arises simultaneously. The fact that a point contact 9 is nearly achieved depends on the runners 11A, 11B being attached by an oblique angle $\alpha$ relative the first interface surface 21 of the tunnel thruster 2, which surface is horizontal. In addition, the actual contact members 14A, 14B of the runners, that constitute the active guiding members during disassembly, are designed as curved surfaces. Hence, at the beginning, the contact point 9 will be positioned close to the ends of said contact surfaces 14A, 14B, and during the progress of the disassembly they will be successively moved away from the ends and towards the centres of the runners 11A, 11B.

Figure 4:
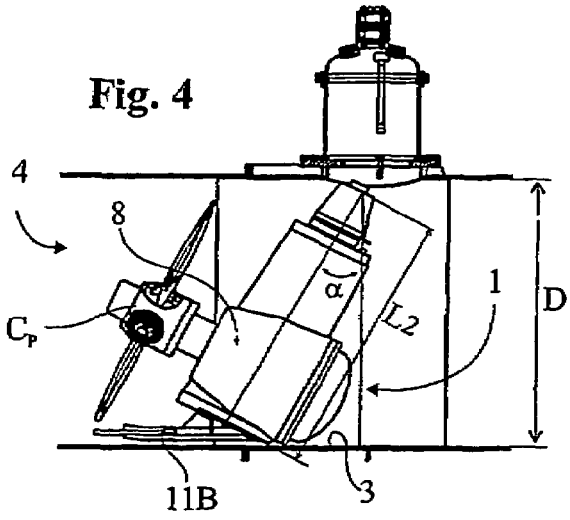
FIG. 4 shows the disassembly in a phase in which the thruster unit is completely disassembled from its position of attachment.

FIG. 4 shows that in a subsequent phase of the disassembly, the runners 11A, 11B rest completely on the bottom of the tunnel wall 3. (See also FIG. 5). In this phase, the entire weight of the tunnel thruster 2 is accordingly carried by the auxiliary device 1. It is clear that in this phase the centre of gravity 8 of the tunnel thruster 2 is positioned a distance in front of the rear edges of the runners 11A, 11B, whereby it is ensured that the unit rests safely on the runners. It is also clear that the tunnel thruster 2 can move freely inside the tunnel 4, thanks to the slope $\alpha$. As an approximation, cosine $\alpha \times L2$ (the maximum height of the thruster unit) is somewhat less than the diameter D of tunnel 4). Another important aspect is that by the inclination $\alpha$, the tunnel thruster 2 still has its propeller centre $C_p$ positioned approximately centrally, since there would otherwise be a risk that a propeller end would bump laterally into the tunnel wall 3.

FIG. 5 shows a view as seen from the tunnel end of the phase of assembly according to FIG. 4. It is clear that there is a clearance for the tunnel thruster 2 both at the top and at the bottom, and that there is a clearance for the propeller ends 20A all the way around the tunnel wall 3. It should also be noted that the guide surfaces 14A, 14B are tilted relative to each other, and adapted to be parallel with the corresponding surfaces of the tunnel wall 3, such that they have an essentially tangential lateral direction relative to the corresponding portion of the tunnel wall 3. This tilting of the surfaces 14A, 14B is the same for the entire bottom surface extending along the runner (see FIG. 7), and it will result in an advantageous guidance when the sledge is moved, such that the movement can be done with great precision, which minimizes the risk of damages for the propeller and/or the tunnel.

FIG. 6 shows a view from above of a preferred embodiment of an auxiliary device 1 according to the invention. It is clear that the runners 11A, 11B are arranged in parallel with each other, and that they are rigidly connected to each other by means of a front strut 19 and a supporting plate 17 that is arranged at the back. At the front, a curved strut 12 is arranged between the runners 11A, 11B, which strut is curved along an arch from one side to the other. The object of this curve is to provide space for a propeller end 20A inside the arch. It is furthermore shown that the supporting plate 17 is provided with a rectangular interface surface 17A that is manufactured with certain tolerances in order to achieve adequate positioning relative to the tunnel thruster 2. Inside this interface surface 17A, a plurality of mounting holes 17B are arranged to be used for the fixing of the auxiliary device 1 to the tunnel thruster 2. It is also shown that the auxiliary device 1 is suitably provided with lifting eye bolts 10, suitably being used also to pull the auxiliary device 1 and the propeller into the tunnel.

FIG. 7 shows the auxiliary device 1 according to FIG. 6, in a side view. Here, it is clear that bracket members 16 are arranged between the runners 11A, 11B and the carrying plate 17, such that a desired angle $\alpha$ is achieved them between. It is also clear that in this preferred embodiment, a runner 11A, 11B can be composed of an upper base part 15, at which lower sliding members 13A, 13B, 14A, 14B are arranged. In this case, the sliding members may be wear members of any suitable material, preferably a plastic material, such as ROBALON™, that during transport allows for a gentle sliding movement on the surface inside the tunnel 4.

Figure 8:
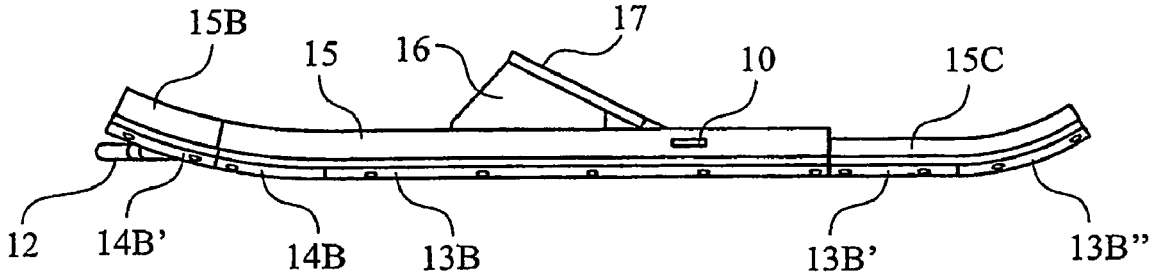
FIG. 8 shows a somewhat modified embodiment of the auxiliary device as seen from the side.

FIG. 8 shows a somewhat modified embodiment of the auxiliary device according to FIG. 7. Here, the same base body as in FIG. 7 is used, for which parts the same reference numerals have been used. It furthermore shown in FIG. 8 that the runners have been extended both in the forwards direction and in the backwards direction, and that they have been bent also at their rear end. A front base part portion 15B is arranged at the upper base part 15 of each runner 11 (exactly the same design on both sides, although FIG. 8, just as FIG. 7, only shows the left runner). An additional sliding member 14B' is arranged at the bottom side of this front base part portion 15B, which additional sliding member connects with sliding member 14B to form an extended curved lower runner surface at the front end. Also at the rear end of the auxiliary device, there is an extended base part portion 15C, which base part member 15C however has a somewhat smaller vertical thickness of material as compared to the base body 15. At the bottom of the rear base part member 15C, sliding members 13B', 13B" are also arranged, which means that a considerably extended sliding surface is obtained, and also a curved one 13B" at the rear end of the auxiliary device.

The invention is not limited to what has been described above but may be varied within the scope of the claims. Accordingly, it is realised that the supporting surface 14A, 14B and/or the runners 11A, 11B, in certain cases can be composed of an integral unit that laterally may be of U-shape. It is also realised that in some cases it may possibly be suitable to use more than two runners. It is also realised that in certain cases the auxiliary device does not have to carry the full load in the guiding during the disassembly, in which case a less strong guide unit is used that before transport (or preferably before the tunnel thruster 2 rests completely on the auxiliary unit/transport unit that is disengaged from the wire 7) can be supplemented by a separate supporting device. It is also realised that even if the assembly as described advantageously can take place underwater, it is obvious that in certain situations the method and the auxiliary device can be used also at dry or semidry conditions. It is also realised that sometimes it may be desired to use the method only in one of the directions, i.e. either for disassembly or for assembly. Finally, it is realised that by "curved portion" is meant a variety of shapes eliminating sharp edges that otherwise would prevent sliding, and also equivalent arrangements aiming at forming a contact point/surface between the auxiliary device 1 and the tunnel wall, in order to achieve sliding. It is also realised that the curved strut 12 without problems can be replaced by a straight strut, i.e. a conventional cross bar, that is positioned at adequate distance to prevent a collision with a propeller end. Finally, the skilled person realises that instead of having sliding members as contact members against the tunnel (or some other surface on which the sledge is transported/moved), wheels, rolls, caterpillar tracks or similar members can, depending on circumstances, be used to achieve a similar but adapted function in order to move the sledge, it however being the case that sliding members of a suitable polymer material have a number of advantages.

The invention claimed is:

1. A method for disassembling or assembling a tunnel thruster unit inside a tunnel comprising:

removably fixing an auxiliary device to the thruster unit before disassembling or assembling the thruster unit at its installed site within the tunnel; and using the auxiliary device to control movement of the thruster unit during disassembly or assembly of the thruster unit at the installed site, wherein using the auxiliary device to control the movement of the thruster unit controls the movement by compressive forces.

2. The method of claim 1, further comprising transporting the thruster unit in the tunnel away from or to the installed site using the auxiliary device, wherein the auxiliary device is adapted to carry the full weight of the thruster unit.

3. The method of claim 1, wherein removably fixing comprises:

providing a first interface on the thruster unit;

providing a second interface on the auxiliary device; and fixing the first interface to the second interface.

4. The method of claim 3, wherein the first interface is directed downwards, such that the thruster unit is carried on top of the auxiliary device during transport.

5. The method of claim 1, wherein using the auxiliary device to control movement comprises positioning the auxiliary device between the thruster unit and an adjacent surface of the tunnel to provide the compressive forces.

6. A method according to claim 5, further comprising providing at least one guiding member on the auxiliary device, and wherein using the auxiliary device to control the movement of the thruster unit comprises one of sliding and turning the at least one guiding member on the adjacent surface.

7. The method of claim 1, where the using the auxiliary device to control movement of the thruster unit takes place underwater.

8. An auxiliary device for providing a controlled assembly or disassembly of a tunnel thruster unit inside a tunnel, comprising:

a rigid base member;

at least one guiding member on the rigid base member;

a contact surface on the at least one guiding member; and a runner on the rigid base member, wherein the at least one guiding member comprises a sliding member arranged at the runner, and wherein the runner comprises at least two elongated members.

9. The auxiliary device of claim 8, wherein the runner extends along a longitudinal axis, wherein the rigid base member includes a carrying plate interface that extends in a plane that forms an acute angle $\alpha$ with the longitudinal axis of the runner, and wherein the acute angle is within a range of approximately $45° > \alpha > 5°$.

10. The auxiliary device of claim 8, wherein the at least one guiding member comprises at least one curved surface.

11. The auxiliary device of claim 8, wherein the at least one guiding member is arranged at a front end of the runner.

12. The auxiliary device of claim 8, wherein the runner is provided with at least one wear member comprising a sliding surface.

* * * * *